US007005949B2

(12) United States Patent
Harada

(10) Patent No.: US 7,005,949 B2
(45) Date of Patent: Feb. 28, 2006

(54) DIELECTRIC FILTER

(75) Inventor: Nobuhiro Harada, Mine (JP)

(73) Assignee: UBE Industries, Ltd., Yamaguchi (JP)

( * ) Notice: Subject to any disclaimer, the term of this patent is extended or adjusted under 35 U.S.C. 154(b) by 0 days.

(21) Appl. No.: 10/829,046

(22) Filed: Apr. 21, 2004

(65) Prior Publication Data

US 2004/0212460 A1 Oct. 28, 2004

(30) Foreign Application Priority Data

Apr. 22, 2003 (JP) ..... 2003-116918

(51) Int. Cl.
*H01P 1/205* (2006.01)

(52) U.S. Cl. ..... 333/206; 333/134

(58) Field of Classification Search ..... 333/202, 333/206, 207, 222, 134
See application file for complete search history.

(56) References Cited

U.S. PATENT DOCUMENTS 4,879,533 A * 11/1989 de Muro et al. ..... 333/206
4,896,124 A * 1/1990 Schwent ..... 333/206
5,929,721 A * 7/1999 Munn et al. ..... 333/134
6,597,263 B1 * 7/2003 Jun et al. ..... 333/202
6,628,180 B1 * 9/2003 Yim ..... 333/202
6,650,202 B1 * 11/2003 Rogozine et al. ..... 333/134

FOREIGN PATENT DOCUMENTS

JP 60-114004 A 6/1985
JP 2002-164708 A 6/2002

* cited by examiner

*Primary Examiner*—Seungsook Ham
(74) *Attorney, Agent, or Firm*—Frommer Lawrence & Haug LLP; Ronald R. Santucci

(57) ABSTRACT

A dielectric filter has a dielectric block 1 having a first end face 1*a*, a second end face disposed in opposite side to the first end face and lateral faces each being disposed between edges of the first and second end faces; a plurality of resonators each having a through hole 6 which lies between the first and second end faces of the dielectric block 1 and is coated with an inner conductor 3, and an outer conductor 5 coated on the second end face and the lateral faces of the dielectric block 1; and input/output electrode 4 which is insulated from the outer conductor 5 and capacitively coupled to one of the resonators at input or output stage on the first end face 1*a*, and extends to a mounting surface which is one of the lateral faces of the dielectric block. The input/output electrode 4 includes a conductor pattern 4*b* formed on the first end face 1*a* and having an inductance component which self-resonates at a predetermined frequency.

8 Claims, 5 Drawing Sheets

DIELECTRIC FILTER

This application claims priority benefits of Japanese Patent Application No. 2003-116918 filed Apr. 22, 2003.

BACKGROUND OF THE INVENTION

1. Field of the Invention

The present invention relates to a dielectric filter having a plurality of resonators formed in a dielectric block. More specifically, the invention relates to a dielectric filter whose spurious characteristics can easily be improved by modifying the pattern of the input/output electrode on its open end face of the dielectric block.

2. Description of the Related Art

Mobile communication devices such as cellular phones use various dielectric filters including duplexer which comprises a transmission filter and a reception filter. A conventional dielectric filter in use has a plurality of coaxial dielectric resonators having resonation holes inside a dielectric block as shown in FIG. 7 (e.g., JP(B)-H3-40962, page 8 and FIG. 2).

Referring to FIG. 7, the dielectric filter has a dielectric block 1 with an approximately hexahedral shape which has a first end face 1*a* and a second end face 1*b* disposed in opposite side to the first end face, a plurality of through holes 6 formed in the dielectric block 1 which extend from the first end face 1*a* to the second end face 1*b*, an inner conductor 3 formed on the inner wall of each through hole 6, a resonator coupling electrode 13 extending on the first end face (open end face) 1*a* from the inner conductor 3, an outer conductor 5 formed on the outer surface of the dielectric block 1, and an input/output electrode 4. The resonator coupling electrodes 13 couple the individual resonators to one another. Particularly, the resonator coupling electrodes 13 formed at the resonator at the input or output stage is used for external coupling with the input/output electrode 4. The input/output electrode 4 is connected to an external circuit on a mount surface A of the dielectric block 1, which is one of lateral faces each being disposed between an edge of the first end face 1*a* and a corresponding edge of the second end face 1*b*.

The conventional dielectric filter having the above-described structure is mounted on the surface of a mount board by soldering in such a way that the mount surface A on which one end portion of the input/output electrode 4 is disposed is put upon the surface of the mount board.

In this type of dielectric filter, a TE mode spurious occurs which has a frequency $f_s$ determined by a specific dielectric constant $\epsilon_r$ of the dielectric block, the cross-sectional area of the dielectric block in a direction parallel to both the axial direction (up and down direction) of the through hole and the layout direction (lengthwise direction of the dielectric block) of the through holes. Given that H and W are respectively the height and length of the dielectric block in FIG. 7, then the cross-sectional area of the dielectric block is H×W. When this spurious frequency is close to a harmonic wave whose frequency is double or triple the resonance frequency of the dielectric resonator, the spurious frequency imparts an undesirable influence on the stable operation or so of the reception circuit system and the transmission circuit system. To avoid such an influence, the conventional dielectric filter should have the size of the dielectric block or the outside size of the dielectric filter changed to set the resonance peak of the spurious frequency apart from the harmonic wave.

One possible solution to this problem is to add a trap resonator (see, for example, JP(A)-2002-164708, page 10 and FIG. 15). FIG. 8 is an exploded perspective view of a dielectric filter 10 to which a trap resonator is added. In this case, the dielectric filter 10, a trapping dielectric resonator 36, a chip capacitor 35 and a connection terminal 37 are laid out on a dielectric mount board 30.

The dielectric filter 10 has four dielectric resonators and a pair of input/output electrodes 4 capacitively coupled to the dielectric resonators of the input and output stages on the open end face. The input/output electrodes 4 extend on the lateral face (bottom side in FIG. 8) of the dielectric block of the dielectric filter 10 and insulated from the outer conductor 5. A ground conductor 33 and a pair of mount board input/output electrodes 31 insulated from the ground conductor 33 are formed on the top surface of the dielectric mount board 30. The outer conductor 5 of the dielectric filter 10 is connected to the ground conductor 33 on the top surface of the dielectric mount board 30 and the input/output electrodes 4 of the dielectric filter 10 are connected to the mount board input/output electrodes 31 on the top surface of the dielectric mount board 30.

The mount board input/output electrode 31 also serves as an electrode to couple with the trapping dielectric resonator 36 and has an extension portion 32 for the connection. One electrode of the chip capacitor 35 is connected to the extension portion 32 and the other electrode of the chip capacitor 35 is connected to the inner conductor of the trapping dielectric resonator 36 via the connection terminal 37. The outer conductor of the trapping dielectric resonator 36 is connected to the ground conductor 33 on the dielectric mount board 30.

Apparently, the addition of the trap resonator requires a lot of parts, such as the dielectric resonator, the chip capacitor and the connection terminal and needs a work like soldering to install the parts at predetermined positions. While the latter conventional case can suppress the spurious, therefore, it has difficulties in making the dielectric filter smaller and reducing the costs for the parts and the manufacturing cost.

SUMMARY OF THE INVENTION

Accordingly, it is an object of the present invention to provide a dielectric filter which can acquire good spurious characteristics without changing the outside size of the dielectric block or increasing the number of parts, and permit reduction in manufacturing cost like the assembling cost.

To achieve the object, according to the invention, there is provided a dielectric filter comprising:

a dielectric block having a first end face, a second end face disposed in opposite side to the first end face and lateral faces each being disposed between edges of the first and second end faces;

a plurality of resonators each having a through hole which lies between the first and second end faces of the dielectric block and is coated with an inner conductor, and an outer conductor coated on the second end face and the lateral faces of the dielectric block; and an input/output electrode which is insulated from the outer conductor and capacitively coupled to one of the resonators at input or output stage on the first end face, and extends to a mounting surface which is one of the lateral faces of the dielectric block, wherein the input/output electrode includes a conductor pattern formed on the first end face and having an inductance component which self-resonates at a predetermined frequency.

In an aspect of the present invention, the input/output electrode has a portion connected to the conductor pattern and capacitively coupled to one of the resonators at input or output stage. In an aspect of the present invention, the conductor pattern is made of a conductive line having a shape with sharp turns. In an aspect of the present invention, an end portion of the conductive line is capacitively coupled to one of the resonators at input or output stage.

In an aspect of the present invention, a trap resonator is formed in the dielectric block and the input/output electrode is capacitively coupled to the trap resonator. In an aspect of the present invention, said input/output electrode is disposed between the trap resonator and one of the resonators at input or output stage. In an aspect of the present invention, the conductor pattern is made of a conductive line having a shape with sharp turns. In an aspect of the present invention, a portion of the conductive line is capacitively coupled to the trap resonator.

According to the present invention, a dielectric filter having a plurality of resonators formed in a dielectric block has an input/output electrode which is formed on the open end face, capacitively coupled to the resonators and extends to the mounting surface of the dielectric block, and a conductor pattern formed on the open end face and having an inductance component that self-resonates at a predetermined frequency. Accordingly, the dielectric filter can acquire good spurious characteristics without changing the outside size of the dielectric block or increasing the number of parts, and permit reduction in manufacturing cost such as the assembling cost.

DESCRIPTION OF THE PREFERRED EMBODIMENTS

Specific embodiments of the present invention are described below with reference to the accompanying drawings.

Figure 1:
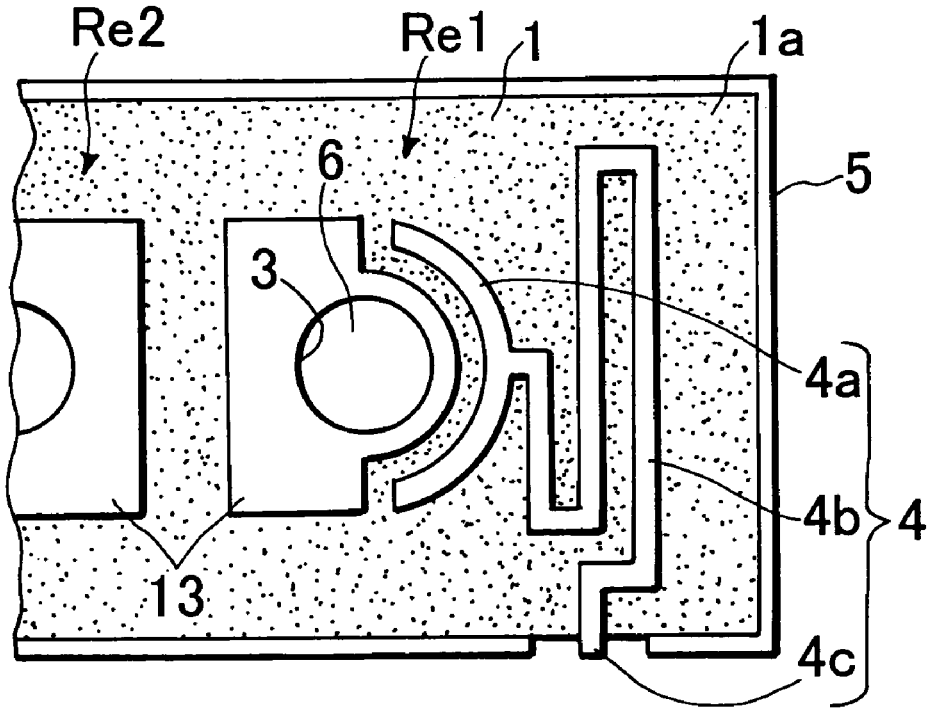
FIG. 1 is a diagram showing a dielectric filter according to an embodiment of the present invention, especially illustrating a conductor pattern of an input/output electrode on an open end face (first end face) of a dielectric block of the dielectric filter.
Figure 7:
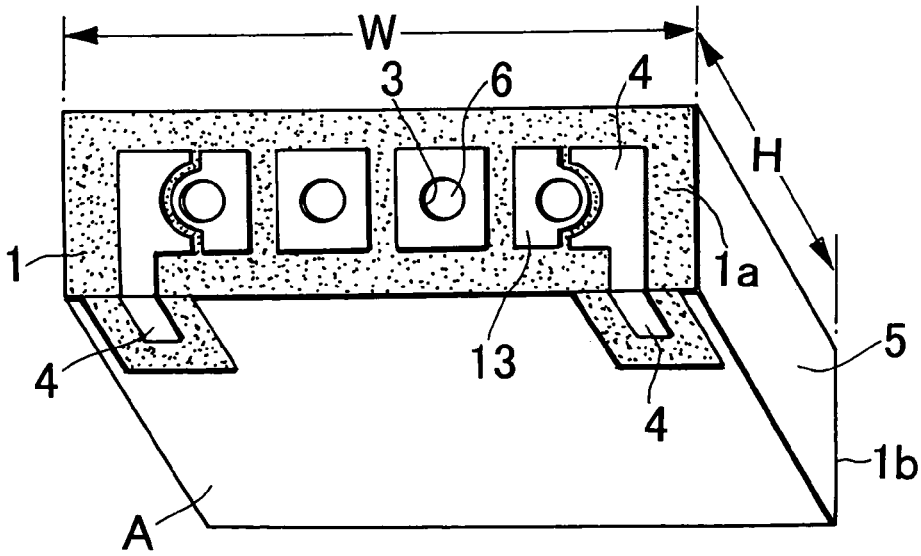
FIG.7 PRIOR ART
FIG. 7 is a perspective view of a conventional dielectric filter having coaxial dielectric resonators having plural resonation holes inside a dielectric block.
Figure 8:
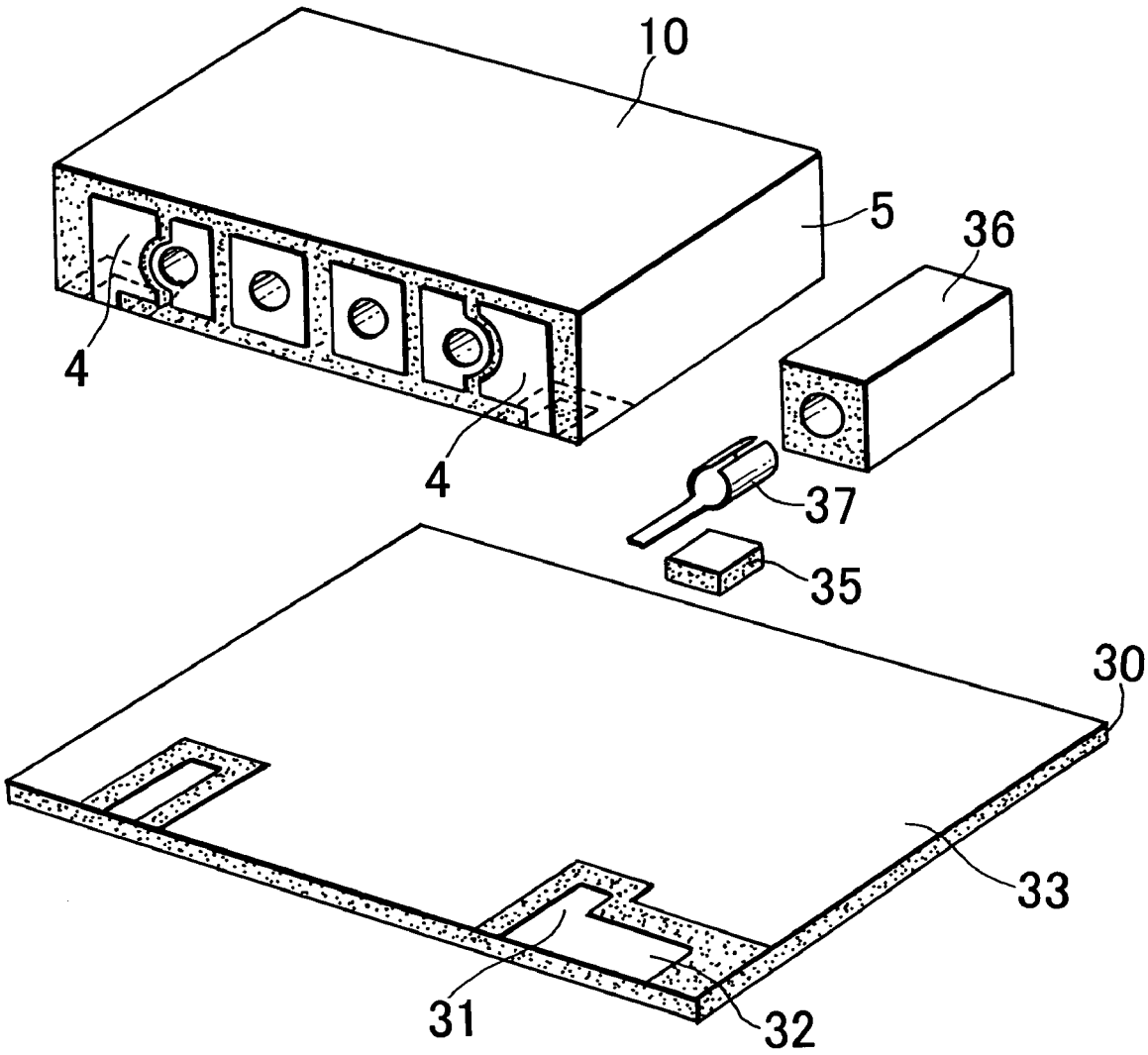
FIG.8 PRIOR ART
FIG. 8 is an exploded perspective view of a conventional dielectric filter to which a trap resonator is added.

FIG. 1 is a plan view illustrating a part of an electrode pattern formed on an open end face (first end face) of a dielectric filter according to the first embodiment of the present invention. An electrode pattern which is approximately the same as the electrode pattern in FIG. 7 is omitted in FIG. 1. The number of through holes and the outside size in the embodiment are the same as those of a conventional case of FIG. 7. That is, the dielectric filter according to the present invention has a dielectric block 1 having a first end face 1*a*, a second end face disposed in opposite side to the first end face and lateral faces each being disposed between edges of the first and second end faces; a plurality of resonators Re1, Re2 . . . each having a through hole 6 which lies between the first and second end faces of the dielectric block 1 and is coated with an inner conductor 3, and an outer conductor 5 coated on the second end face and the lateral faces of the dielectric block 1; and input/output electrode 4 which is insulated from the outer conductor 5 and capacitively coupled to one of the resonators at input or output stage on the first end face 1*a*, and extends to a mounting surface which is one of the lateral faces of the dielectric block 1. The input/output electrode 4 includes a conductor pattern 4*b* formed on the open end face (first end face) 1*a* and having an inductance component which self-resonates at a predetermined frequency. That is, the conductor pattern 4*b* is a portion of the input/output electrode 4, which has an inductance component which self-resonates at a predetermined frequency.

As shown in FIG. 1, the input/output electrode 4 has a portion 4*a* connected to one end portion of the conductor pattern 4*b* and capacitively coupled to a resonator coupling electrode 13 of the resonator Re1 at input or output stage. The other end portion 4*c* of the conductor pattern 4*b* extends to the mount surface while being insulated from the outer conductor 5 formed on the mount surface of the dielectric block 1, to thereby be connected to the input/output electrode of a mount board. The conductor pattern 4*b* is made of a conductive line having a shape with sharp turns.

The conductor pattern 4*b* of the input/output electrode 4 has a self-resonance frequency determined by its own inductance and a parasitic capacitance. The spurious characteristics at the desired frequency can be improved by setting the conductor pattern 4*b* (line width, line length, line layout, etc.) in such a way as to have an inductance component which self-resonates at a frequency at which the spurious characteristics are suppressed.

Figure 2:
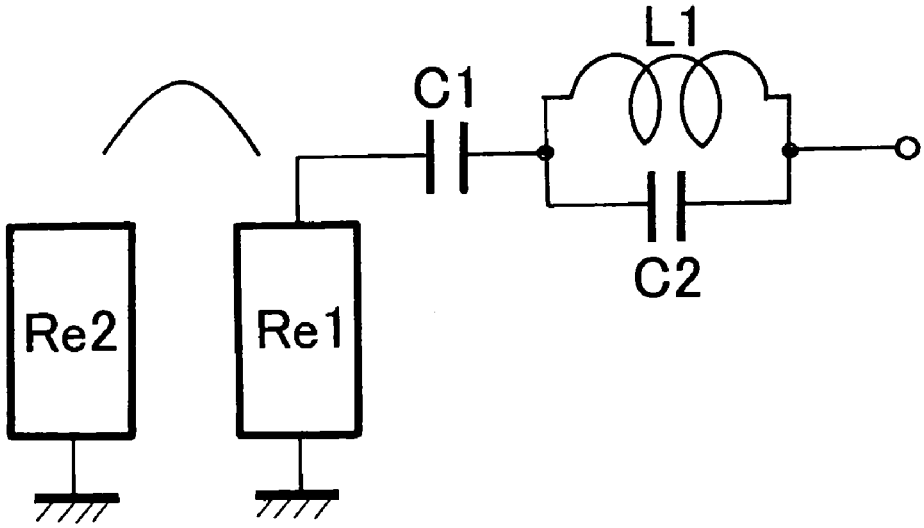
FIG. 2 is an equivalent circuit diagram of the electrode portion on the open end face in the embodiment shown FIG. 1.

FIG. 2 shows an equivalent circuit of the electrode portion on the open end face of the dielectric filter of FIG. 1. A part of the circuit of the dielectric filter is omitted in the equivalent circuit of FIG. 2 as in FIG. 1. C1 is an inter-electrode capacitor formed between the resonator coupling electrode 13 of and the portion 4*a* of the input/output electrode 4 adjoining the coupling electrode 13. L1 is an inductance obtained by the conductor pattern 4*b*. C2 is a parallel parasitic capacitance produced when the conductor pattern 4*b* of the input/output electrode 4 is formed. The spurious characteristics at the desired frequency can be improved by setting the self-resonance frequency of a resonator which is formed by the inductance L1 and the capacitance C2 to the frequency that suppresses the spurious characteristics.

Figure 3:
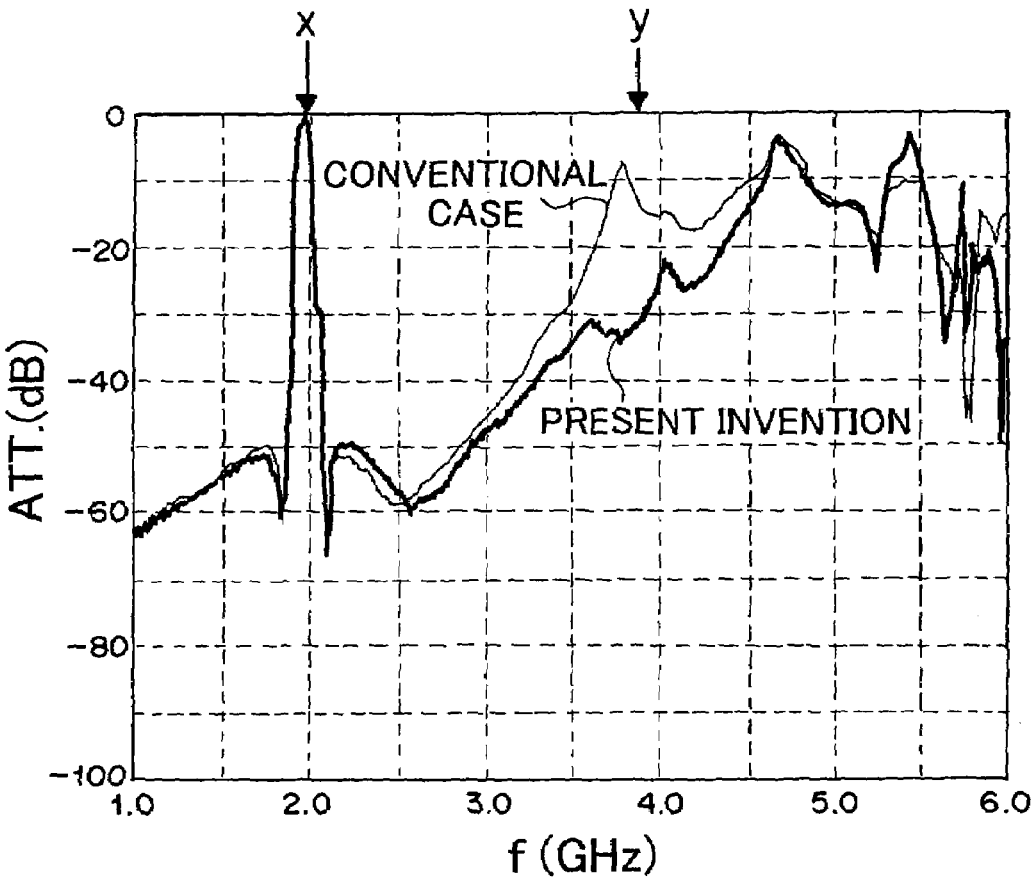
FIG. 3 is a diagram showing the frequency characteristics of the embodiment shown in FIG. 1 and a conventional case shown in FIG. 6.

FIG. 3 presents a frequency characteristic chart according to the above-described embodiment. FIG. 3 also shows the frequency characteristic chart for the conventional dielectric filter shown in FIG. 7 for comparison. Those portions of the embodiment of FIG. 1 excluding the electrode pattern constituting the inductance component are the same as those of the conventional dielectric filter of FIG. 7 in the electrode pattern on the open end face, the number of through holes and the outside size.

Referring to FIG. 3, x denotes the central frequency of a pass band, and y denotes a frequency twice the central frequency. In the embodiment of the present invention where the input/output electrode is provided with the conductor pattern 4*b* which has such an inductance component as to self-resonate at a predetermined frequency, the amount of attenuation (ATT.) at the frequency twice the frequency of pass band is improved as compared with the conventional dielectric filter (dielectric band pass filter).

Figure 4:
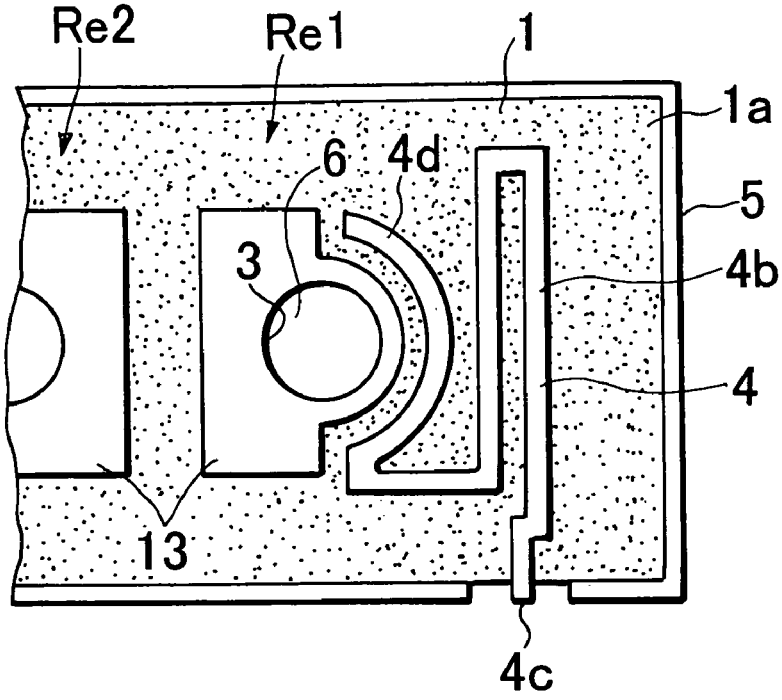
FIG. 4 is a diagram showing a dielectric filter according to another embodiment of the present invention, especially illustrating the conductor pattern of the input/output electrode on the open end face (first end face) of the dielectric block of the dielectric filter.

FIG. 4 is a plan view illustrating a part of an electrode pattern on an open end face (first end face) of a dielectric filter according to the second embodiment of the present invention. An electrode pattern which is approximately the same as the electrode pattern of FIG. 7 is omitted in FIG. 4. While the conductor pattern 4*b* of the input/output electrode constituting the inductance component is formed in addition to the conductor portion 4*a* to provide the capacitive coupling with the resonator coupling electrode in the first embodiment of FIG. 1, an end portion 4*d* of the conductor pattern 4*b* constituting the inductance component of the input/output electrode is itself so formed as to provide the capacitive coupling with the resonator coupling electrode 13 in the second embodiment of FIG. 4. That is, in this embodiment, the end portion 4*d* of the conductive line of the conductor pattern 4*b* is capacitively coupled to the resonator Re1 at input or output stage. This structure can provide a compact dielectric filter which needs smaller space for the electrodes while having improved spurious characteristics.

Figure 5:
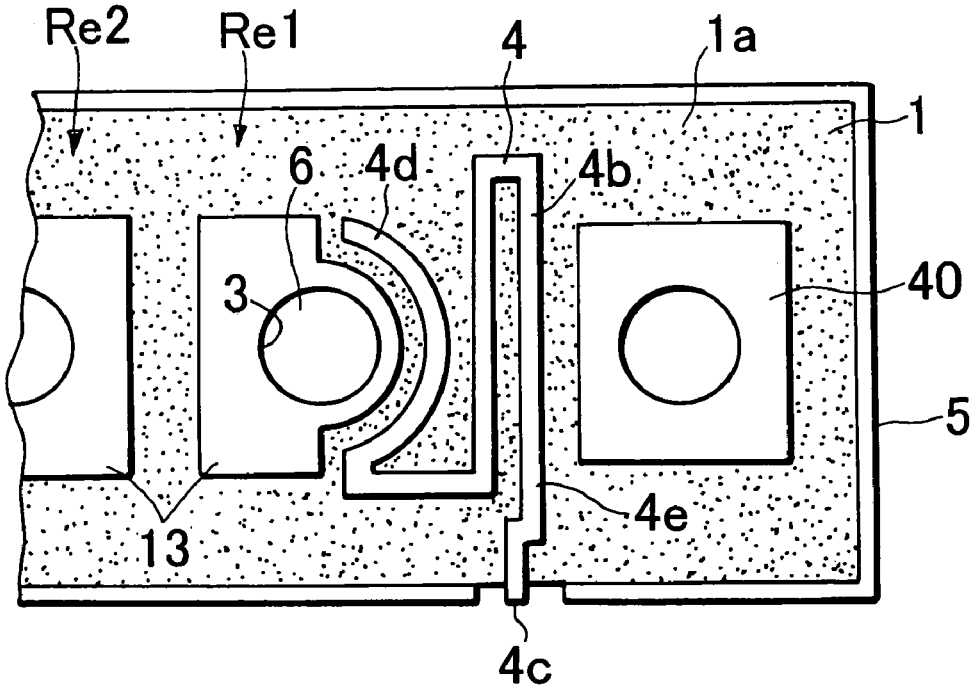
FIG. 5 is a diagram showing a dielectric filter according to still another embodiment of the present invention, especially illustrating the conductor pattern of the input/output electrode on the open end face (first end face) of the dielectric block of the dielectric filter.

FIG. 5 is a plan view illustrating a part of an electrode pattern on an open end face (first end face) of a dielectric filter according to the third embodiment of the present invention. An electrode pattern which is approximately the same as the electrode pattern of FIG. 7 is omitted in FIG. 5. In the third embodiment, a trap resonator 40 is formed in the dielectric block 1 and the input/output electrode 4 is capacitively coupled to the trap resonator 40. The input/output electrode 4 is disposed between the trap resonator 40 and the resonator Re1 at input or output stage. The conductor pattern 4*b* is made of a conductive line having a shape with sharp turns. A portion 4*e* of the conductive line of the conductor pattern 4*b* is capacitively coupled to the trap resonator 40.

That is, a resonator for trapping (trap resonator 40) to further improve the attenuation outside the pass band is added to the dielectric filter of the second embodiment. According to the third embodiment, the end portion 4*d* of the conductor pattern 4*b* that constitutes the inductance component is capacitively coupled to the resonator coupling electrode 13 of the resonator Re1 at input or output stage, and the portion 4*e* of the conductor pattern 4*b* is capacitively coupled to the trap resonator 40. This structure can provide a dielectric filter which has good spurious characteristics and good attenuation characteristics near the pass band while achieving size reduction.

Although the foregoing description explains the embodiments which have four resonators and the embodiment which has one trap resonator added to the four resonators, the present invention can be adapted to a dielectric filter which has more than or less than four resonators.

According to the present invention, the input/output electrode which includes the conductor pattern having an inductance component may be formed at both the input and output stages or may be formed at one of the input and output stages. The method of coupling resonators in the present invention is not restricted to the use of the coupling electrode formed on the open end face as shown in FIGS. 1, 4 and 5.

Although the foregoing description of the present invention has been given of a dielectric band pass filter that has an input/output electrode which includes the conductor pattern having an inductance component, the input/output electrode of the present invention can be adapted to a duplexer which comprises transmission and reception filters.

Figure 6:
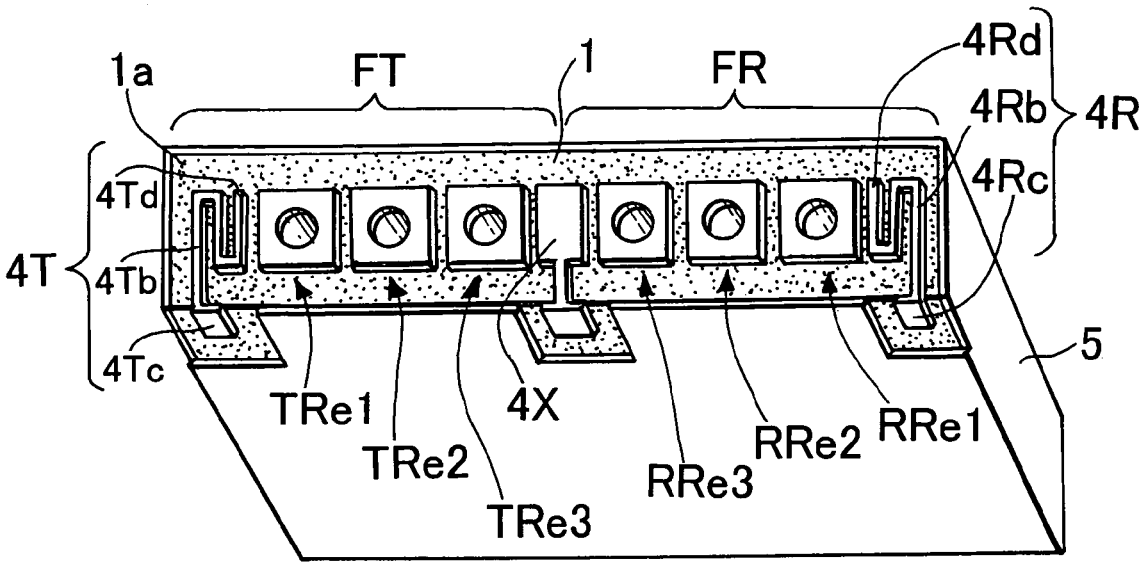
FIG. 6 is a diagram showing an embodiment of a duplexer including a dielectric filter according the present invention, especially illustrating a conductor pattern of an input/output electrode on an open end face (first end face) of a dielectric block of the duplexer.

FIG. 6 is a perspective view of an embodiment of the duplexer. As shown in FIG. 6, the duplexer comprises two filters, i.e. a transmission filter FT and a reception filter FR, for each of which the dielectric filter of the present invention is used. The transmission filter FT has three resonators TRe1, TRe2 and TRe3, an input electrode 4T and a common electrode 4X. The reception filter FR has three resonators RRe1, RRe2 and RRe3, an output electrode 4R and the common electrode 4X. The transmission and reception filters FT, FR are formed on the same dielectric block 1.

The input electrode 4T has a conductor pattern 4Tb constituting the inductance component. As in the same manner as the embodiment of FIG. 4, one end portion 4Td of the conductive line of the conductor pattern 4Tb is capacitively coupled to the resonator TRe1, and the other end portion 4Tc of the conductor pattern 4Tb extends to the mount surface while being insulated from the outer conductor 5 formed on the mount surface of the dielectric block 1.

Similarly, the output electrode 4R has a conductor pattern 4Rb constituting the inductance component. One end portion 4Rd of the conductive line of the conductor pattern 4Rb is capacitively coupled to the resonator RRe1, and the other end portion 4Rc of the conductor pattern 4Rb extends to the mount surface while being insulated from the outer conductor 5 formed on the mount surface of the dielectric block 1.

That is, the conductor pattern of the present invention which is formed on the first end face 1*a* of the dielectric block 1 and has such an inductance component as to self-resonate at a predetermined frequency may be applied to any one of the input and output electrodes 4T, 4R of the duplexer. The conductor pattern of the present invention also may be applied to the common electrode 4X of the duplexer. This can improve the high frequency characteristics such as the transmission pass characteristics, the reception pass characteristics and the isolation characteristics.

What is claimed is:

1. A dielectric filter comprising:

a dielectric block having a first end face, a second end face disposed in opposite side to said first end face and lateral faces each being disposed between edges of said first and second end faces;

a plurality of resonators each having a through hole which lies between said first and second end faces of said dielectric block and is coated with an inner conductor, and an outer conductor coated on said second end face and said lateral faces of said dielectric block; and an input/output electrode which is insulated from said outer conductor and capacitively coupled to one of said resonators at input or output stage on said first end face, and extends to a mounting surface which is one of said lateral faces of said dielectric block, wherein said input/output electrode includes a conductor pattern formed on said first end face and made of a conductive line having two linear portions extending in parallel to each other and facing each other, said conductor pattern having an inductance component which self-resonates at a frequency at which spurious of said filter is suppressed.

2. The dielectric filter according to claim 1, wherein said input/output electrode has a portion connected to said conductor pattern and capacitively coupled to one of said resonators at input or output stage.

3. The dielectric filter according to claim 1, wherein said conductive line has a shape with a plurality of sharp turns.

4. The dielectric filter according to claim 3, wherein an end portion of said conductive line is capacitively coupled to one of said resonators at input or output stage.

5. The dielectric filter according to claim 1, wherein a trap resonator is formed in said dielectric block and said input/output electrode is capacitively coupled to said trap resonator.

6. The dielectric filter according to claim 5, wherein said input/output electrode is disposed between said trap resonator and one of said resonators at input or output stage.

7. The dielectric filter according to claim 5, wherein said conductive line has a shape with a plurality of sharp turns.

8. The dielectric filter according to claim 7, wherein a portion of said conductive line is capacitively coupled to said trap resonator.

* * * * *